US006279370B1

(12) United States Patent
Awad

(10) Patent No.: US 6,279,370 B1
(45) Date of Patent: Aug. 28, 2001

(54) HYDRAULIC ARRANGEMENT FOR PERFORMING A SECONDARY OPERATION IN A PRESSING TOOL FOR SHEET METAL FORMING

(75) Inventor: Mattias Awad, Karlskoga (SE)

(73) Assignee: Stromsholmen AB, Tranas (SE)

( * ) Notice: Subject to any disclaimer, the term of this patent is extended or adjusted under 35 U.S.C. 154(b) by 0 days.

(21) Appl. No.: 09/496,760

(22) Filed: Feb. 3, 2000

(30) Foreign Application Priority Data

Feb. 5, 1999 (EP) ..... 99102253

(51) Int. Cl.[7] ..... B21J 7/24; B21J 7/28

(52) U.S. Cl. ..... 72/453.02; 72/472; 83/588; 100/296.06

(58) Field of Search ..... 72/453.02, 453.1, 72/453.11, 472, 453.18; 100/269.06; 83/588, 639.5

(56) References Cited

U.S. PATENT DOCUMENTS 4,148,209 * 4/1979 Bessho ..... 72/453.02
4,209,987 * 7/1980 Kononov et al. ..... 100/269.06
4,321,818 3/1982 Bessho ..... 72/453.02
5,038,598 8/1991 Pitzer ..... 72/453.02
5,640,877 * 6/1997 Danly, Sr. ..... 72/453.02
5,855,114 1/1999 Runesson ..... 60/413

* cited by examiner

*Primary Examiner*—David Jones
(74) *Attorney, Agent, or Firm*—Altera Law Group, LLC

(57) ABSTRACT

The invention relates to an arrangement for performing a secondary operation in a pressing tool for sheet metal forming comprising a primary cylinder/piston unit (1) arranged to pressurise an operating fluid upon closing of said pressing tool for performing a primary forming operation on a work piece. A secondary cylinder/piston unit (7) is mounted within said pressing tool, carrying tooling for conducting said secondary operation mounted on its piston rod **(7*c*). The arrangement further comprises means (2, 20, 21) for storing said pressurised operating fluid and means for selectively allowing a first volume flow of operating fluid of a first pressure to the secondary cylinder/piston unit (7), for advancing its piston rod (7*c*) until the tooling encounters the work piece. Further it comprises means for allowing a second volume flow of operating fluid of a second, relatively higher, pressure to the secondary cylinder/piston unit (7)**, as the tooling encounters said work piece, for performing the secondary forming operation.

9 Claims, 4 Drawing Sheets

HYDRAULIC ARRANGEMENT FOR PERFORMING A SECONDARY OPERATION IN A PRESSING TOOL FOR SHEET METAL FORMING

The present invention relates to an hydraulic arrangement for performing a secondary operation in a pressing tool for sheet metal forming.

The present invention further relates to a method for performing a secondary operation in a pressing tool for sheet metal forming.

In sheet metal forming operations, for example, it is usual to arrange a passive hydraulic system in the pressing tool. This is done in order to be able to shift some of the pressing force to another position and another direction, for example in order to be able to perform yet another operation in the same tool. Such a system can be achieved by arranging a primary hydraulic cylinder/piston unit in a lower tool half in such a way that the piston is pressed into the cylinder when the tool is closed. The oil flow from the primary hydraulic cylinder/piston unit can thus be used in order to produce a stroke in a secondary hydraulic cylinder/piston unit. The timing of the said stroke usually coincides with the closing of the tool but can also be delayed trough the use of a pressurised accumulator for storing the oil that flows from the primary hydraulic cylinder/piston unit, which after a predetermined time delay can be used to produce the stroke in the secondary hydraulic cylinder/piston unit. A device of the aforementioned kind is disclosed in U.S. Pat. No. 5,038 598.

The high pressures associated with the secondary operation of the known devices as well as the relatively large flows occurring for each stroke of the secondary hydraulic cylinder/piston unit requires a substantial amount of energy, which during each stroke is partially transformed into heat which must be removed from the system in order for it to operate satisfactorily.

One object of the present invention is to provide an arrangement , which generates less heat during operation and displays some or all of the advantages stated below.

Another object is to provide a method, which minimises the energy requirements during operation and displays some or all of the advantages stated below.

Preferred embodiments of the arrangement and method according to the present invention also comprise one or more of the characterising features according to the dependent claims.

The inventive design has several advantages in comparison with prior art systems: It generates less heat during operation, wherefore no cooling system is required; the absence of a cooling system makes that the system requires less space, is easier to install and maintain and use; has less pressure variation, which causes less stress to the components; smaller flows, which makes the use of smaller and more accessible components possible; the piston of the first accumulator, of the preferred embodiments, does not encounter a physical stop, which brings about less stress on the first accumulator and less pressure fluctuations in the system; the piston of the primary cylinder/piston unit does not encounter a physical stop, which brings about less stress on this unit. The method according to the invention allows for optimising the energy consumption and thus less heating of the operating fluid.

Preferred embodiments of the invention will be further explained below with reference to drawings enclosed, in which.

Figure 1:
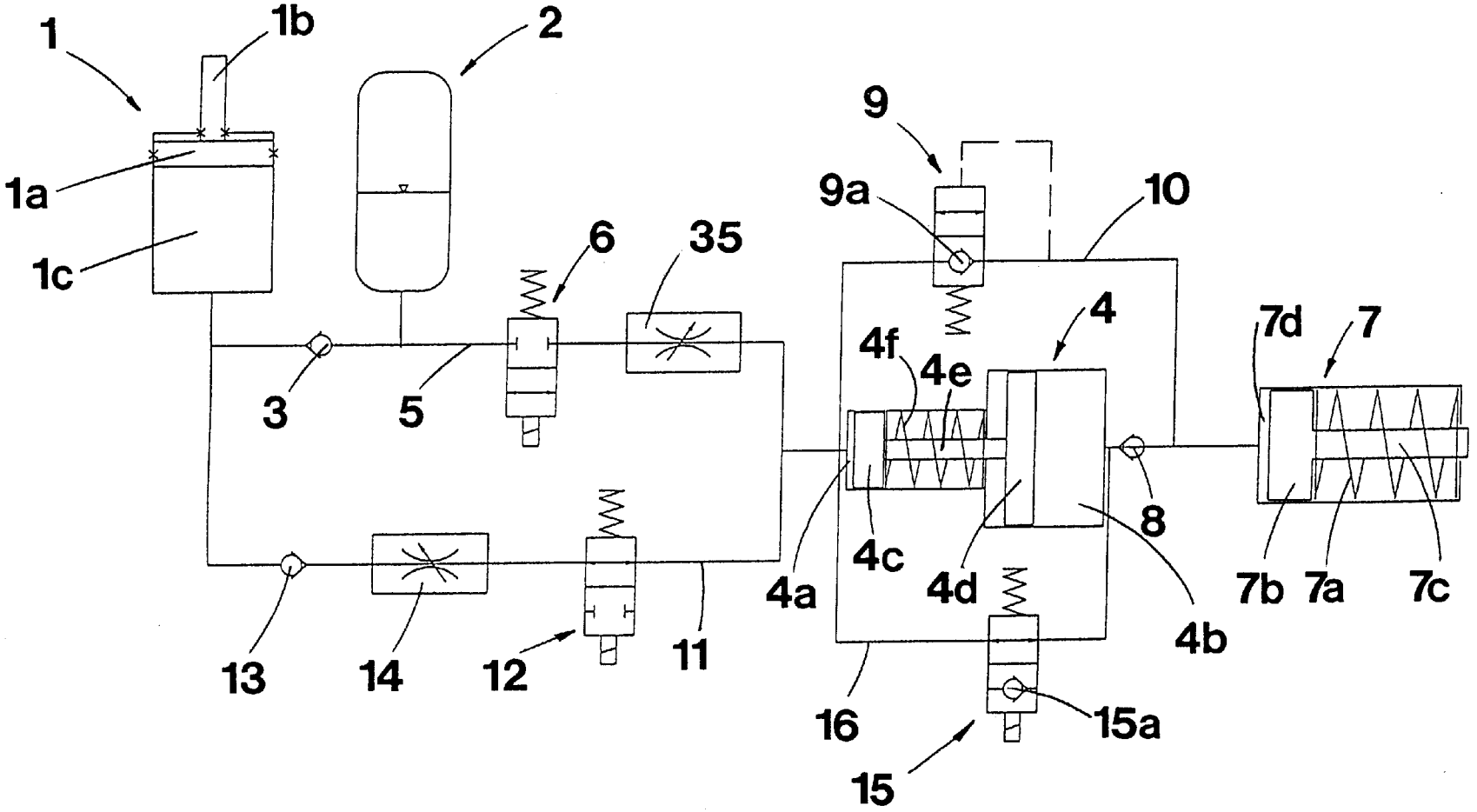
FIG. 1 shows a preferred embodiment of the arrangement in accordance with the invention.

FIG. 1 shows a preferred embodiment of an arrangement for performing a secondary operation in a press for sheet metal forming according to the invention. The arrangement being intended for a press having upper and lower platens (not shown) moveable towards each other by operation of the press to bring respective upper and lower dies (not shown) located on said upper and lower platens into contact with a sheet metal work piece (not shown) to perform a primary forming operation. In this embodiment a primary hydraulic cylinder/piston unit 1 is adapted to be mounted to move with one of said platens to extend towards the other platen. The primary hydraulic cylinder/piston unit 1 includes a piston 1*a* and piston rod 1*b*, a chamber 1*c* beneath said piston 1*a* containing an operating fluid and arranged in fluid connection with a pressurised first accumulator 2, for example a piston accumulator, via a first non return valve 3. Said first non return valve 3 only allowing for a flow from the primary hydraulic cylinder/piston unit 1 and on to the first accumulator 2.

The apparatus further comprises means (not shown) for engaging said piston rod 1*b* upon operation of said press and movement of said platens. Upon engagement of the piston rod 1*b* of the primary hydraulic cylinder/piston unit 1 the piston rod 1*b* is arranged to act on the piston 1*a* of the primary hydraulic cylinder/piston unit 1 to pressurise said operating fluid in said chamber 1*c*, which then is arranged to flow to the first accumulator 2.

The pressurised first accumulator 2 includes a confined volume of a compressible fluid and means (e.g. a piston) for progressively compressing said volume of fluid responsive to the continued engagement of the piston rod 1*b* of the primary hydraulic cylinder/piston unit 1 to thereby create stored energy by operation of said press during the primary forming operation.

The pressurised first accumulator 2 is in fluid connection with a first chamber 4*a* of a pressure converter 4 by way of line 5 containing a first two way valve 6, which is designed to selectively permit a flow between the pressurised first accumulator 2 and the first chamber 4*a* of the pressure converter 4. A first throttle device 35 is also arranged in the above line 5.

The pressure converter 4, as shown, consists of the first chamber 4*a* and a second chamber 4*b* containing first 4*c* and second 4*d* pistons respectively. The first 4*c* and second 4*d* pistons of the pressure converter 4 are arranged on the same piston rod 4*e*.

The effective area of the first piston 4*c* is smaller than the effective area of the second piston 4*d*. The pressure converter 4 comprises spring means 4*f* arranged to, when no pressure is applied, move the first piston 4*c* to minimise the volume of the first chamber 4*a* and thereby maximise the volume of the second chamber 4*b*. The aforementioned arrangement of the pressure converter 4 ensures that upon a flow of pressurised fluid of a first pressure from the pressurised first accumulator 2 and into the first chamber 4*a* of the pressure converter 4 the first piston 4*c* thereof moves inwards causing the second piston 4*d* to pressurise operating fluid contained in the second chamber 4*b* of the pressure converter 4.

A secondary hydraulic cylinder/piston unit 7 is in fluid connection with the second chamber 4*b* of the pressure converter 4 via a second non return valve 8, only allowing for a flow in this direction, and the secondary hydraulic cylinder/piston unit 7 is designed to perform another operation within the same pressing tool. The secondary hydraulic cylinder/piston unit 7 is, when not pressurised, arranged to return to a compressed position by way of a return spring 7*a*. The secondary hydraulic cylinder/piston unit 7 includes a piston 7*b* and piston rod 7*c*, a chamber 7*d* beneath said piston 7*b* for receiving the operating fluid and arranged in fluid connection with the second chamber 4*b* of the pressure converter 4 as described above.

A third non return valve 9*a* is arranged in the unactuated position of a pressure sensing two way valve 9. Said pressure sensing two way valve 9 being arranged in a line 10 bypassing the pressure converter 4 in it being arranged between the first chamber 4*a* of the pressure converter 4 and the chamber 7*d* of the secondary hydraulic cylinder/piston unit 7. The pressure sensing two way valve 9 is arranged to sense the pressure in the chamber 7*d* of the secondary hydraulic cylinder/piston unit 7 and to open the bypass line 10 upon sensing a predetermined pressure in the chamber 7*d* of the secondary hydraulic cylinder/piston unit 7. The third non return valve 9*a* of the pressure sensing two way valve 9 is designed to, upon the secondary hydraulic cylinder/piston units 7 return to the compressed position, permit a flow from the secondary hydraulic cylinder/piston unit 7 back to the primary hydraulic cylinder/piston unit 1 by way of an additional line 11 containing a third two way valve 12, which is designed to selectively permit a flow between the first chamber 4*a* of the pressure converter 4 and the primary hydraulic cylinder/piston unit 1. A fourth non return valve 13 is arranged in the same line 11 to prevent a flow in the opposite direction. A second throttle device 14 is also included in the line 11 between the third two way valve 12 and the fourth non return valve 13. A second two way valve 15 is arranged in an additional bypass line 16 arranged between the first 4*a* and the second chamber 4*b* of the pressure converter 4. Said second two way valve 15 can selectively be opened to permit a flow from the first 4*a* to the second chamber 4*b* of the pressure converter 4 or closed, whereby a flow is only allowed in the opposite direction, i.e. from the second 4*b* to the first chamber 4*a* of the pressure converter 4 by means of a fifth non return valve 15*a*.

During operation, i.e. one work cycle of the press, initially the first 6, second 15 and third 12 two way valves are closed as the press closes to perform the primary forming operation. The operating fluid contained in the primary hydraulic cylinder/piston unit 1 will thereby flow from the primary cylinder/piston unit 1, as the piston 1*b* thereof is moved to reduce the volume of its chamber 1*c*, and on to the pressurised first accumulator 2 where it will be pressurised, for example to 170 bar.

After completion of the primary forming operation and whilst the pressing tool is still closed or after opening thereof the secondary operation can be initiated. This is effectuated trough the first two way valve 6 opening and permitting operating fluid to flow from the pressurised first accumulator 2 and into the first chamber 4*a* of the pressure converter 4 where it causes the first piston 4*c* thereof to move inwards. As the fist piston 4*c* of the pressure converter 4 is moved inwards the second piston 4*d* of the pressure converter 4 is moved to decrease the volume of the second chamber 4*b* of the pressure converter 4, thereby causing operating fluid in the second chamber 4*b* to flow therefrom and into the secondary hydraulic cylinder/piston unit 7, the operating stroke of which is thereby initiated. Due to the design of the pressure converter 4 a larger volume (e.g. 2,5 times larger) will flow out from the second chamber 4*b* than will flow into the first chamber 4*a*, the pressure of the operating fluid leaving the second chamber 4*b* will however be substantially lower than the pressure of the operating fluid entering the first chamber 4*a*. Therefore the piston rod 7*c* of the secondary hydraulic cylinder/piston unit 7 will initially move relatively fast forward.

As the piston rod 7*c* of the secondary hydraulic cylinder/piston unit 7 contacts the sheet metal work piece upon which the secondary operation is to be performed it will be retarded and as a consequence thereof the pressure in the chamber 7*d* of the secondary hydraulic cylinder/piston unit 7 will rise. As the pressure rises above a predetermined pressure (e.g. 45 bar) the pressure sensing two way valve 9 will open the line 10 allowing a flow of operating fluid to bypass the pressure converter 4 and flow directly from the pressurised first accumulator 2 to the secondary hydraulic cylinder/piston unit 7, in which the pressure is thereby further increased causing its piston rod 7*c* to be advanced further to perform the final part of the secondary operation with full force.

After the press has been opened and the secondary forming operation completed the first two way valve 6 is closed, thereby preventing a flow from the first accumulator 2 to the primary cylinder 1. The second 15 and third 12 two way valves are then opened to, as the piston 7*b* of the secondary hydraulic cylinder/piston unit 7 is forced back by the return spring 7*a*, allowing for a return flow to the primary hydraulic cylinder/piston unit 1 and to the second chamber 4*b* of the pressure converter 4. Hereby only the operating fluid required to perform the secondary operation is returned to the primary hydraulic cylinder/piston unit 1 and not the pressurised operating fluid remaining in the first accumulator 2, which means that the energy stored therein will not be completely drained during each work cycle to cause an unnecessary heating of the operating fluid. The above arrangement reduces the cooling requirements as the energy consumption during each work cycle is reduced and adapted to the specific requirements of the secondary operation to be performed.

The arrangement is now ready to perform another work cycle after removal of the formed sheet metal work piece, after which the above sequence can be repeated.

Figure 2:
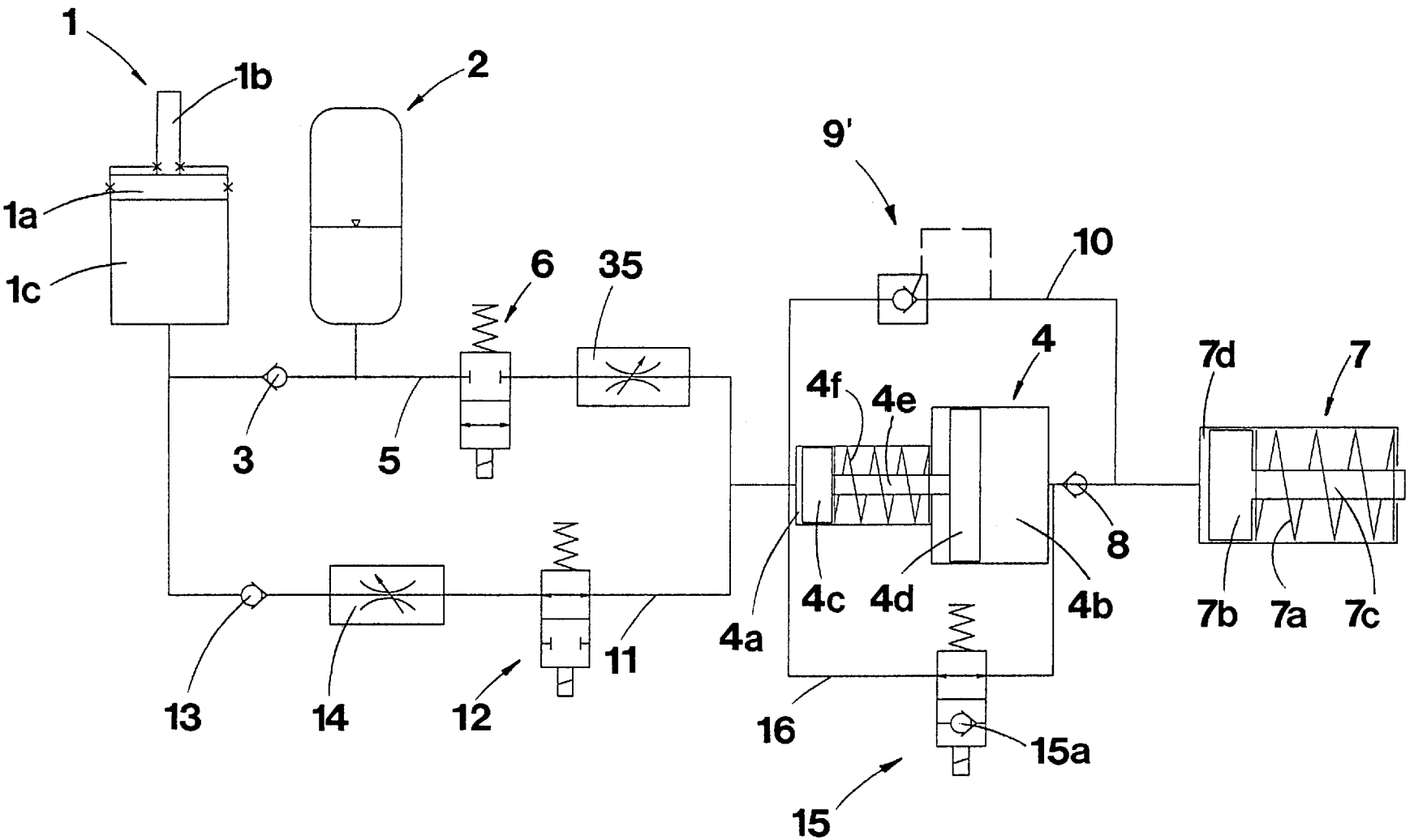
FIG. 2 shows a second embodiment which is similar to the preferred embodiment but utilises a pressure controlled non-return valve, having the same function as the pressure controlled two way valve of the preferred embodiment.

The second embodiment, according to FIG. 2, only differs from the preferred first embodiment in that the pressure sensing valve is replaced by a pressure sensing non return valve 9', which is arranged to allow for a flow of operating fluid in the normally closed direction bypassing the pressure converter 4 upon sensing a predetermined pressure in the chamber 7*d* of the secondary hydraulic cylinder/piston unit 7. All other components are the same as in the preferred first embodiment. The arrangement according to this second embodiment is to be operated in the same way as the arrangement according to the preferred first embodiment wherefore the above description thereof applies also hereto.

Figure 3:
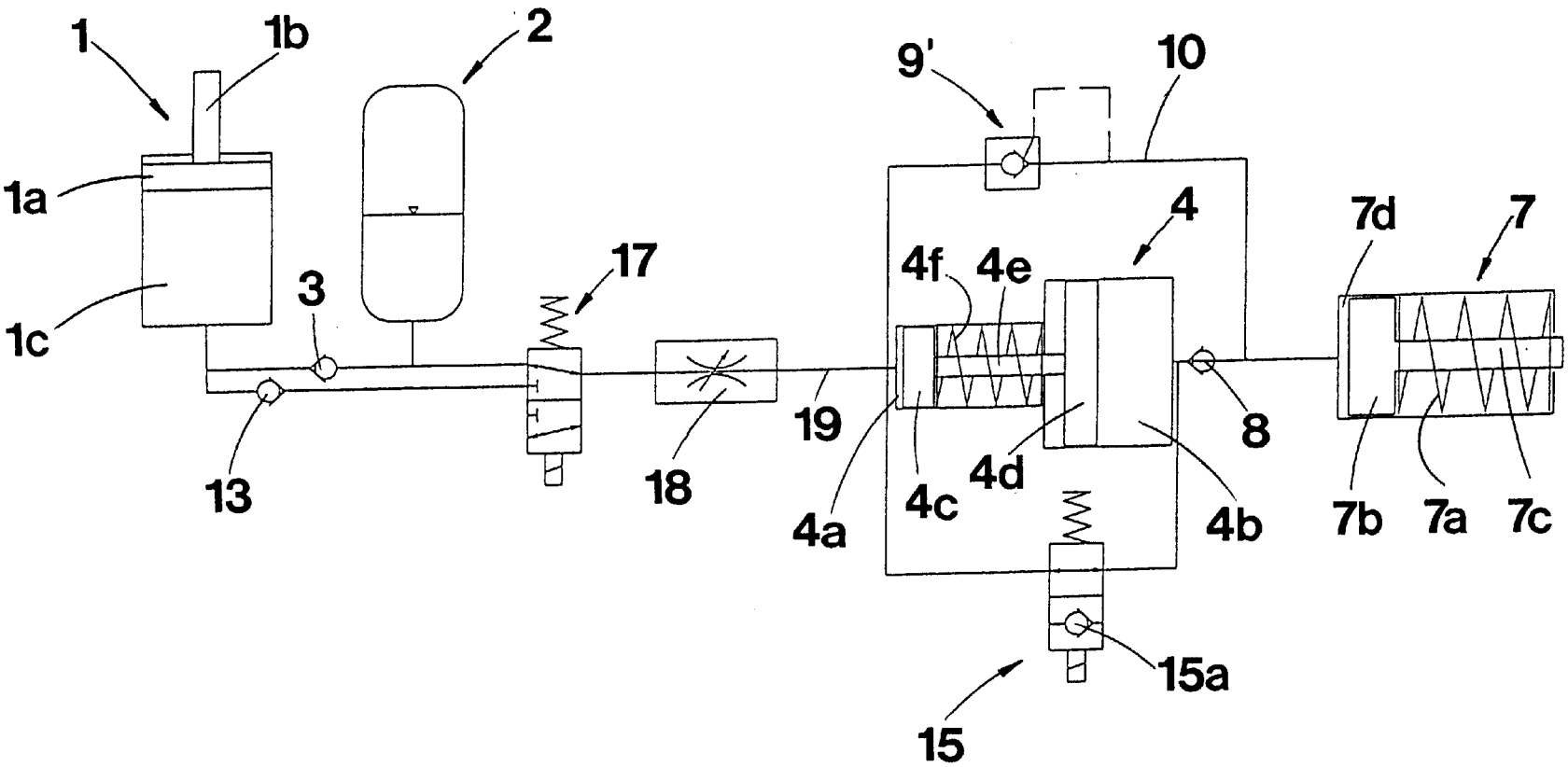
FIG. 3 shows a third embodiment, which is also similar to the second embodiment and utilises a 3–2 , valve to control the work and return strokes of the secondary cylinder/piston unit.

The third embodiment, according to FIG. 3, differs from the second embodiment in that the first and third two way valves are replaced with a 3–2 valve 17, which perform the same functions as the replaced valves and thus the arrangement according to this third embodiment is to be operated in the same way as the arrangement according to the preferred first embodiment wherefore the above description thereof applies also hereto. The first and second throttle devices are also eliminated in this embodiment and replaced with a common third throttle device 18 in the line 19 connecting the 3–2 valve 17 with the first chamber 4*a* of the pressure converter 4. All other components are the same as in the second embodiment.

Figure 4:
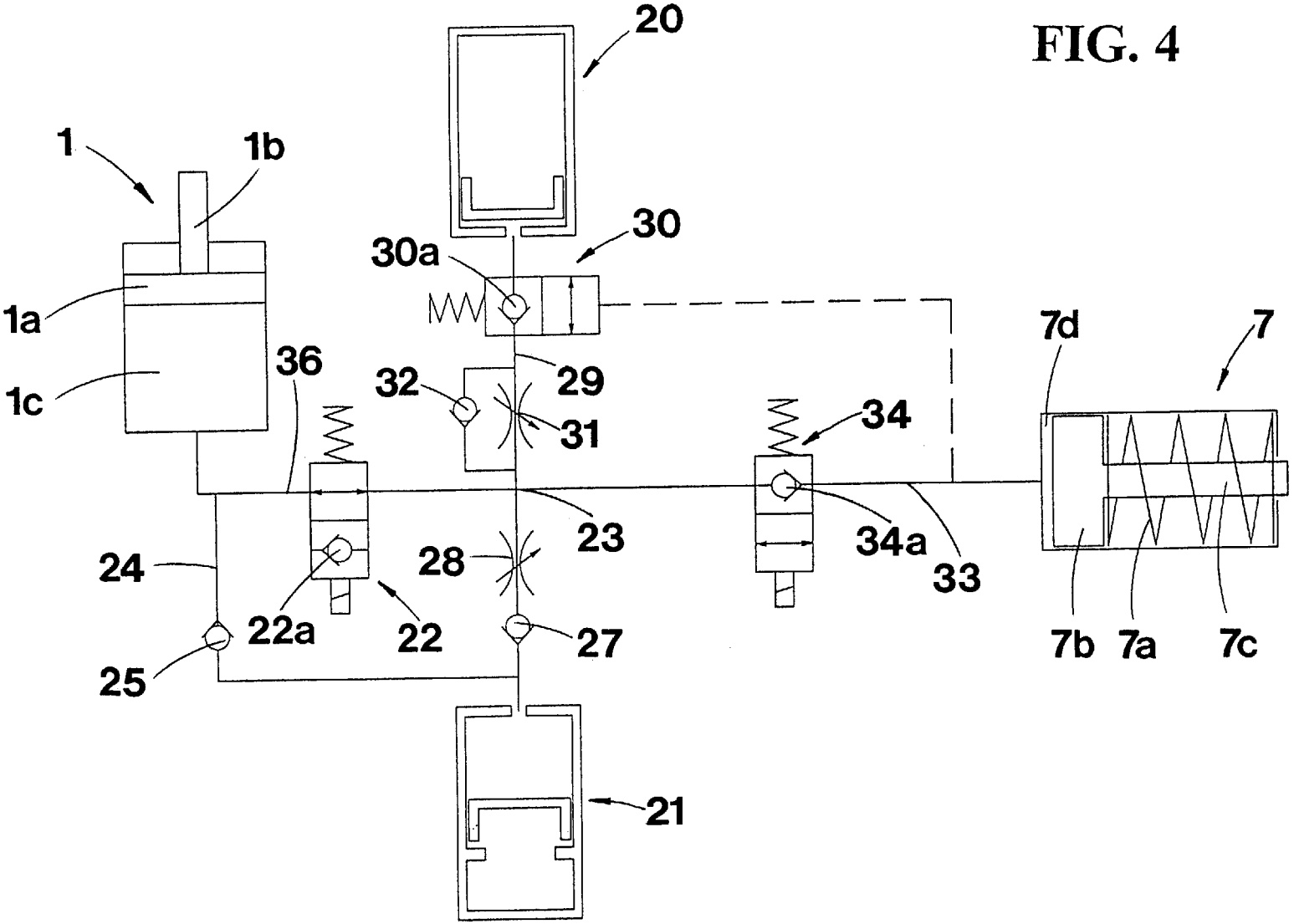
FIG. 4 shows a fourth embodiment using a low and a high pressure accumulator and lacking some of the advantages of the embodiments in accordance with FIGS. 1 to 3.

In a fourth embodiment according to FIG. 4 the pressure converter 4 of the embodiments described above has been replaced with two separate second 20 and third 21 accumulators, where the second accumulator 20 is a high pressure accumulator of the kind used in the previous arrangements. The third accumulator 21 is of the same kind but restricted in order only to allow operating fluid therein to be put under less pressure than in the second high pressure accumulator 20, e.g. 40% thereof.

A fourth two way valve 22 is arranged in a line 36 connecting the primary hydraulic cylinder/piston unit 1 with a fluid intersection point 23 and can selectively be opened to permit a flow from the fluid intersection point 23 to the primary hydraulic cylinder/piston unit 1 or closed, whereby a flow is only allowed in the opposite direction, i.e. from the primary hydraulic cylinder/piston unit 1 to the fluid intersection point 23 by means of a eleventh non return valve 22*a*. An additional line 24 connects the primary hydraulic cylinder/piston unit 1 with the third low pressure accumulator 21 and contains a sixth non return valve 25 only allowing for a flow from the primary hydraulic cylinder/piston unit 1 to the third low pressure accumulator 21. The third low pressure accumulator 21 is connected with the fluid intersection point 23 by way of a line 26 containing a seventh non return valve 27 and a fourth throttle device 28. The seventh non return valve 27 only allowing for a fluid flow from the third accumulator 21 to the fluid intersection point 23.

The second accumulator 20 is connected with the fluid intersection point 23 by way of a line 29 containing a pressure sensing two way valve 30 arranged to sense the pressure in the chamber 7*d* of the secondary hydraulic cylinder/piston unit 7 and to open the line 29 upon sensing a predetermined pressure in the chamber 7*d* of the secondary hydraulic cylinder/piston unit 7. When closed the pressure sensing two way valve 30 presents an eleventh non return valve 30*a* only allowing for a flow into the second accumulator 20. Between the pressure sensing two way valve 30 and the fluid intersection point 23 is further arranged a fifth throttle device 31 in parallel with a ninth non return valve 32, which ninth non return valve 32 only allows for a fluid flow from the fluid intersection point 23 towards the pressure sensing two way valve 30 bypassing the fifth throttle device 31.

The secondary hydraulic cylinder/piston unit 7 is connected with the fluid intersection point 23 by way of a line 33 containing a fifth two way valve 34, which selectively can be opened to permit a fluid flow from the fluid intersection point 23 to secondary hydraulic cylinder/piston unit 7 or closed, whereby a fluid flow is only allowed in the opposite direction, i.e. from the secondary hydraulic cylinder/piston unit 7 to the fluid intersection point 23 by means of a tenth non return valve 34*a*.

Upon the closing of the press the operating fluid contained in the primary hydraulic cylinder/piston unit 1 flows through the sixth non return valve 25 and into the third low pressure accumulator 21. When the third low pressure accumulator 21 reaches its restricted saturation, the operating fluid flows through the eleventh 22*a*, ninth 32 and eight 30*a* non return valves and into the second high pressure accumulator 20. The flow of operating fluid continues until the press reaches its fully closed position during the primary forming operation.

For performing the secondary forming operation the fifth two way valve 34 is brought to open, whereby operating fluid flows from the third accumulator 21 to the secondary hydraulic cylinder/piston unit 7 through the seventh non return valve 27 and the fourth throttle device 28.

As the piston rod 7*c* of the secondary hydraulic cylinder/piston unit 7 contacts the sheet metal work piece upon which the secondary operation is to be performed it will be retarded and as a consequence thereof the pressure in the chamber 7*d* of the secondary hydraulic cylinder/piston unit 7 will rise. As the pressure rises above a predetermined pressure (e.g. 45 bar) the pressure sensing valve 30 will open a line 29 allowing a flow of operating fluid from the second accumulator 20 and through the fifth throttle device 31 and the fifth, still open, two way valve 34 on to the secondary hydraulic cylinder/piston unit 7, in which the pressure is thereby further increased causing its piston rod 7*c* to be advanced further to perform the final part of the secondary operation with full force. The seventh non return valve 27 thereby prevents a return flow into the third accumulator 21.

After the press has been opened and the secondary forming operation completed the fourth two way valve 22 is opened, whereby the operating fluid flows from the secondary cylinder/piston unit 7 and back to the primary cylinder/piston unit 1. As the pressure sensed by the pressure sensing two way valve 30 will decrease rapidly as the fourth two way valve 22 is opened the pressure sensing two way valve 30 will close and thus prevent any operating fluid still contained in the second accumulator 20 to flow back into the primary cylinder/piston unit 1. Hereby only the operating fluid required to perform the secondary operation is returned to the primary hydraulic cylinder/piston unit 1 and not the pressurised operating fluid remaining in the second accumulator 20, which means that the energy stored therein will not be completely drained during each work cycle to cause an unnecessary heating of the operating fluid. The above arrangement reduces the cooling requirements as the energy consumption during each work cycle is reduced and adapted to the specific requirements of the secondary operation to be performed.

The arrangement is now ready to perform another work cycle after removal of the formed sheet metal work piece and closing of the fourth 22 and fifth 34 two way valves, after which the above sequence can be repeated.

The invention is obviously not limited to the embodiments described above by way of an example, but lends its self to modifications within the scope of the idea of the invention defined in the claims below. In a still further embodiment it is possible to combine the arrangement according to FIG. 4 with the pressure sensing non return valve 9' according to the FIG. 2 embodiment, i.e. replacing the pressure sensing two way valve 30 with the pressure sensing non return valve 9'.

The throttle devices of all of the above embodiments are arranged to allow for controlling the speed of the work and return stroke of the secondary hydraulic cylinder/piston unit 7 and as such are components of which the person skilled in the art are well familiar, wherefore no additional description thereof is given in the above text.

What is claimed is:

1. Arrangement for performing a secondary operation in a pressing tool for sheet metal forming, comprising a primary cylinder/piston unit (1) including a piston rod (1*b*) and a piston (1*a*) arranged to pressurise an operating fluid upon closing of said pressing tool for performing a primary forming operation on a sheet metal work piece, characterised in that a secondary cylinder/piston unit (7) is mounted within said pressing tool, said secondary cylinder/piston unit (7) having a piston (7*b*) and a piston rod (7*c*), and tooling for conducting said secondary operation mounted on said piston rod (7*c*), the arrangement further comprising means (2, 20, 21) for storing said pressurised operating fluid and means for selectively allowing a first volume flow of operating fluid of a first pressure to the secondary cylinder/piston unit (7), for advancing the piston (7*b*) and piston rod (7*c*) thereof until the tooling encounters the sheet metal work piece upon which it is designed to act and means for allowing a second volume flow of operating fluid of a second, relatively higher, pressure to the secondary cylinder/piston unit (7), as the tooling encounters said sheet metal work piece, for performing the secondary forming operation upon said work piece.

2. Arrangement according to claim 1, characterised in that the means for allowing the first volume flow comprises a pressure converter (4), in fluid connection with said storing means (2) by way of a first valve (6, 17) arranged to selectively permit a flow of operating fluid from the storing means (2) to said pressure converter (4), which pressure converter (4) further is arranged to upon receiving said flow of operating fluid produce a larger output volume flow than said received volume flow, said output volume flow being of lower pressure than said received volume flow and said output volume flow constituting said first volume flow.

3. Arrangement according to claim 2, characterised in that the means for allowing the second volume flow is a pressure sensing valve (9, 9'), arranged to upon sensing a predetermined pressure of the operating fluid in the secondary cylinder/piston unit (7) allow for said second volume flow through permitting a flow from the storing means (2) to the secondary cylinder/piston unit (7) bypassing the pressure converter (4).

4. Arrangement according to claim 1, characterised in that the means for storing said pressurised operating fluid consists of a low pressure accumulator (21) and a high pressure accumulator (20) and the means for selectively allowing the first volume flow is a two way valve (34) arranged to selectively permit fluid flow from the low pressure accumulator (21) to the secondary cylinder/piston unit (7) and the means for allowing the second volume flow is a pressure sensing valve (9, 9', 30) arranged to upon sensing a predetermined pressure in the operating fluid of the secondary cylinder/piston unit (7) permit fluid flow from the high pressure accumulator (20) to said secondary cylinder/piston unit (7).

5. Arrangement according to claim 3, characterised in that the means for allowing the second volume flow is a pressure sensing two way valve (9, 30).

6. Arrangement according to claim 3, characterised in that the means for allowing the second volume flow is a pressure sensing non return valve (9').

7. Arrangement according to claim 1, characterised in that it further comprises means for returning a volume flow of operating fluid equal to said first and second volume flows to the primary cylinder/piston unit (1) upon completion of said secondary forming operation and said pressing tool being open.

8. Method for performing a secondary operation in a pressing tool for sheet metal forming, characterised in that it comprises the steps of: pressurising an operating fluid through compressing a primary cylinder/piston unit (1) upon closing said pressing tool for performing a primary operation; storing said pressurised operating fluid; using said pressurised operating fluid for pressurising a secondary cylinder/piston unit (7), carrying tooling for conducting said secondary operation, in such a way, that the piston (7*b*) and piston rod (7*c*) of said secondary cylinder/piston unit (7) initially, before the tooling encounters the sheet metal work piece upon which it is designed to act, is advanced by a fist volume flow of operating fluid of a first pressure and as the work piece is encountered, is advanced by a second volume flow of operating fluid of a second pressure, said second pressure being higher than said first pressure and said first volume flow being greater than said second volume flow.

9. Method according to claim 8, characterised in that a volume flow of operating fluid equal to said first and second volume flows is returned to the primary cylinder/piston unit (1) upon completion of said secondary forming operation said pressing tool being open.

* * * * *